US012390697B1

(12) United States Patent
Zaleznick et al.

(10) Patent No.: US 12,390,697 B1
(45) Date of Patent: Aug. 19, 2025

(54) CARBON FIBER PUTTER GOLF SHAFT AND TIP WITH ONE OR MORE BENDS

(71) Applicant: True Temper Sports, Inc., Memphis, TN (US)

(72) Inventors: Jonah Gil Zaleznick, San Diego, CA (US); Donald Collins Brown, Jr., San Diego, CA (US); Jake Ryan Gniffke, San Diego, CA (US)

(73) Assignee: TRUE TEMPER SPORTS, INC., Memphis, TN (US)

( * ) Notice: Subject to any disclaimer, the term of this patent is extended or adjusted under 35 U.S.C. 154(b) by 0 days.

(21) Appl. No.: 18/983,252

(22) Filed: Dec. 16, 2024

Related U.S. Application Data

(60) Provisional application No. 63/677,586, filed on Jul. 31, 2024.

(51) Int. Cl.

| | |
|---|---|
| ***A63B 53/02*** | (2015.01) |
| ***A63B 53/00*** | (2015.01) |
| ***A63B 53/04*** | (2015.01) |
| ***A63B 53/10*** | (2015.01) |

(52) U.S. Cl.
CPC ..... *A63B 53/02* (2013.01); *A63B 53/007* (2013.01); *A63B 53/0487* (2013.01); *A63B 53/10* (2013.01); *A63B 2209/02* (2013.01)

(58) Field of Classification Search
CPC ... A63B 53/02; A63B 53/007; A63B 53/0487; A63B 53/10; A63B 2209/02
See application file for complete search history.

(56) References Cited

U.S. PATENT DOCUMENTS

| | | | | |
|---|---|---|---|---|
| 2003/0079839 | A1* | 5/2003 | Fenton, Jr. | A63B 60/00 156/425 |
| 2022/0409967 | A1* | 12/2022 | Boretto | A63B 53/10 |
| 2024/0367016 | A1* | 11/2024 | Kelly | B29C 53/82 |

FOREIGN PATENT DOCUMENTS

| | | | | |
|---|---|---|---|---|
| WO | WO-2024173355 | A1 * | 8/2024 | A63B 60/42 |

OTHER PUBLICATIONS

New LA Golf single bend graphite putter shaft—2024 Farmers Insurance Open. Tour and Pre-Release Equipment. Golf WRX. Jan. 23, 2024. https://forums.golfwrx.com/topic/1978899-new-la-golf-single-bend-graphite-putter-shaft-2024-farmers-insurance-open/.

* cited by examiner

*Primary Examiner* — Jeffrey S Vanderveen

(57) ABSTRACT

A carbon fiber tip to connect a straight carbon fiber golf shaft with a golf club head includes: a first end that is cylindrical and that is configured to be joined with the golf club head; a second end that opposite the first end, that is cylindrical, and that is configured to be joined with a tip end of the straight carbon fiber golf shaft; and a bend disposed between the first end and the second end that changes an axis along which the carbon fiber tip extends.

19 Claims, 16 Drawing Sheets

CARBON FIBER PUTTER GOLF SHAFT AND TIP WITH ONE OR MORE BENDS

CROSS-REFERENCE TO RELATED APPLICATIONS

This application claims the benefit of U.S. Provisional Application No. 63/677,586, filed on Jul. 31, 2024. The entire disclosure of the application referenced above is incorporated herein by reference.

FIELD

The present disclosure relates to golf equipment and more to carbon fiber golf shafts for putters.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Golf shafts are manufactured in various lengths for various different types of golf clubs. Some golf shafts are steel golf shafts, and some golf shafts are graphite golf shafts.

In golf, golf clubs are used to strike golf balls. An object is to move a golf ball from tee to a hole in a fewest number of strokes. Various types of golf clubs are used, such as woods, irons, wedges, and putters. Golf shafts include a tip end where a golf club head is attached and a butt end where a golf grip is applied.

Multiple different types of golf club heads are used. For example, a set of golf clubs includes one or more woods, one or more irons and wedges, and a putter.

SUMMARY

In a feature, a carbon fiber tip to connect a straight carbon fiber golf shaft with a golf club head is described. The carbon fiber tip includes: a first end that is cylindrical and that is configured to be joined with the golf club head; a second end that opposite the first end, that is cylindrical, and that is configured to be joined with a tip end of the straight carbon fiber golf shaft; and a bend disposed between the first end and the second end that changes an axis along which the carbon fiber tip extends.

In further features, a golf club includes: the straight carbon fiber golf shaft having a tip end and a grip end that is opposite the tip end; the golf club head; and the carbon fiber tip, where the first end of the carbon fiber tip is joined with the golf club head and the second end of the carbon fiber tip is joined with the tip end of the straight carbon fiber golf shaft. In further features, the golf club head is a putter head.

In further features, the first end of the carbon fiber tip is fixed to the golf club head via an adhesive.

In further features, the second end of the carbon fiber tip is fixed to the tip end of the straight carbon fiber golf shaft via an adhesive.

In further features, the second end of the carbon fiber tip is fixed to the tip end of the straight carbon fiber golf shaft via the carbon fiber tip and the straight carbon fiber golf shaft having been cured together.

In further features, the first end includes a cylindrical recessed portion configured to receive a cylindrical post on the golf club head.

In further features, the first end includes one or more apertures that extend through the carbon fiber tip to the cylindrical recessed portion.

In further features, an outer diameter of the first end is between 0.3 inches to 0.4 inches.

In a feature, a tip includes: the carbon fiber tip; and a cylindrical tube disposed within the second end that extends outwardly past the second end of the carbon fiber tip.

In further features, the carbon fiber tip is co-molded onto the cylindrical tube.

In further features, the cylindrical tube is to extend into a tip end of the straight carbon fiber golf shaft.

In further features, the cylindrical tube is made of one of steel, a metal, an alloy, and carbon fiber.

In further features, the straight carbon fiber golf shaft is straight axially and does not include any bends along the axis of the straight carbon fiber golf shaft.

In further features, a second bend is disposed between (a) the bend and (b) the first end.

In further features, the carbon fiber tip: extends axially along a first axis between the bend and the second end; extends axially along a second axis between the bend and the second bend; and extends axially along a third axis between the second bend and the first end, where the first axis is not coaxial with the second axis, and the second axis is not coaxial with the third axis.

In further features, the first axis is not coaxial with the third axis.

In further features, the first axis intersects the second axis at only one point, and the second axis intersects the third axis at only one point.

In a feature, a golf shaft for a putter is described, where the golf shaft includes: a straight carbon fiber golf shaft having a tip end and a grip end that is opposite the tip end; and the carbon fiber tip, the first end of the carbon fiber tip to be joined with the golf club head and the second end of the carbon fiber tip to be joined with the tip end of the straight carbon fiber golf shaft.

In a feature, a one piece carbon fiber golf shaft for a putter is described. The one piece carbon fiber golf shaft includes: a grip end that is cylindrical and that is configured to be fixed within a golf grip; a tip end that is cylindrical and that is configured to be joined with a putter head, where the tip end is opposite the grip end; and at least one bend disposed between the grip end and the tip end, the at least one bend changing an axis along which the one piece carbon fiber golf shaft extends.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

The present application involves an carbon fiber tip portion that includes one or more bends. The carbon fiber tip portion can be connected to a straight carbon fiber golf shaft to create a carbon fiber golf shaft for a putter that includes one or more bends. Single piece golf shafts including one or more bends are difficult and costly to manufacture and may be susceptible to breaking at or near a bend.

Figure 1:
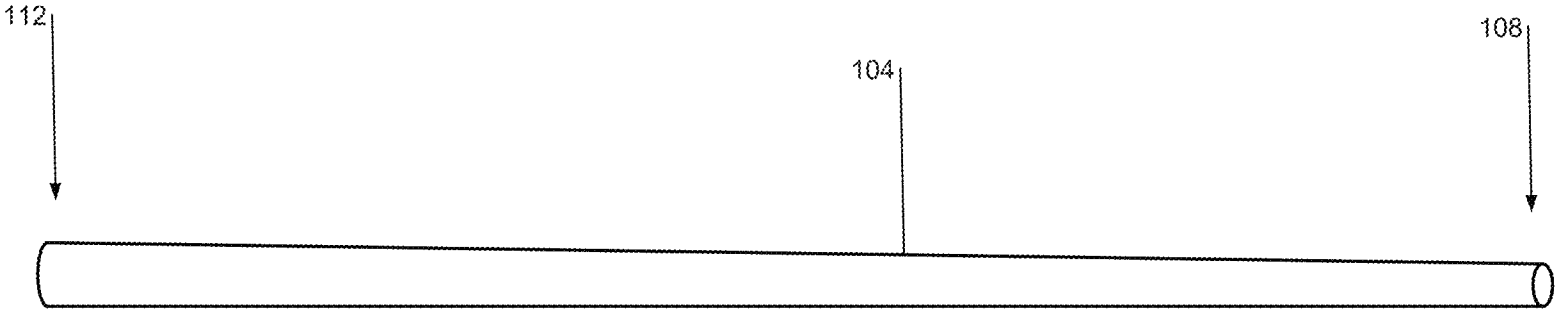
FIG. 1 includes an example illustration of a golf club shaft.

FIG. 1 includes an example illustration of a golf club shaft 104 prior to joining the golf shaft 104 with a golf club head, such as a putter head. The golf shaft 104 may be a straight carbon fiber golf shaft or straight graphite golf club shaft. While the example of a straight graphite golf club shaft is provided, the present application is also applicable to straight steel golf club shafts, straight hybrid steel and graphite golf club shafts, and other types of straight golf club shafts. The golf shaft 104 may include one or more tapered (stepped) outer portions or may be a stepless shaft. An interior of the golf shaft 104 is hollow. The straight golf club shaft 104 includes zero bends and extends along one axis.

The golf shaft 104 includes a tip end 108 and a butt end 112. The outer diameter of the butt end 112 may be greater than the outer diameter of the tip end 108. A golf club head can be attached via the tip end 108 of the golf shaft 104. A golf grip can be fixed at the butt end 112 of the golf shaft 104 and extend toward the tip end 108. An interior diameter of the golf shaft 104 may decrease moving from the butt end 112 toward the tip end 108. The decreasing may be gradual via tapered portions and/or stepwise in the example of stepped portions.

Figure 2:
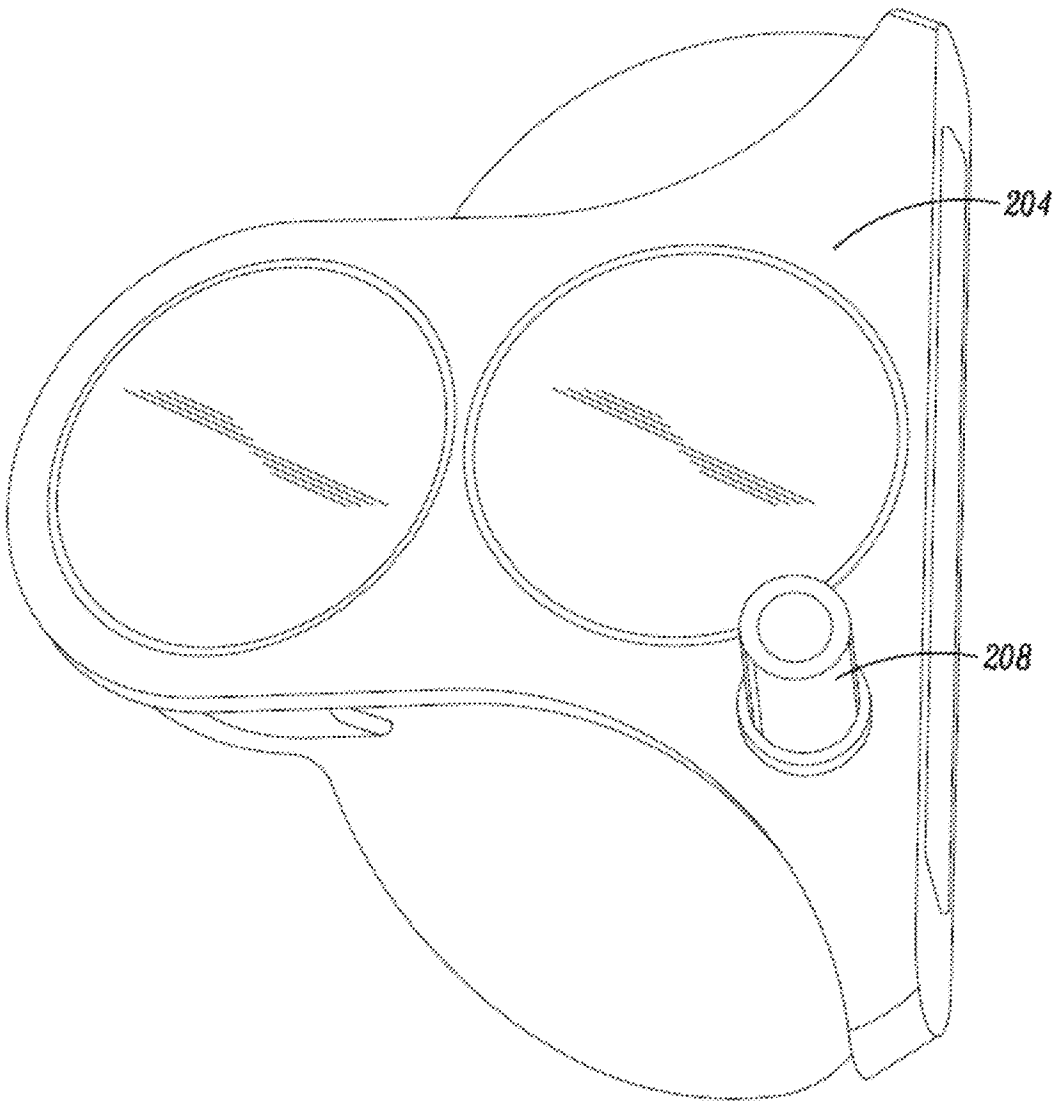
FIG. 2 is a perspective view of a left-handed putter head including a cylindrical post.
Figure 3:
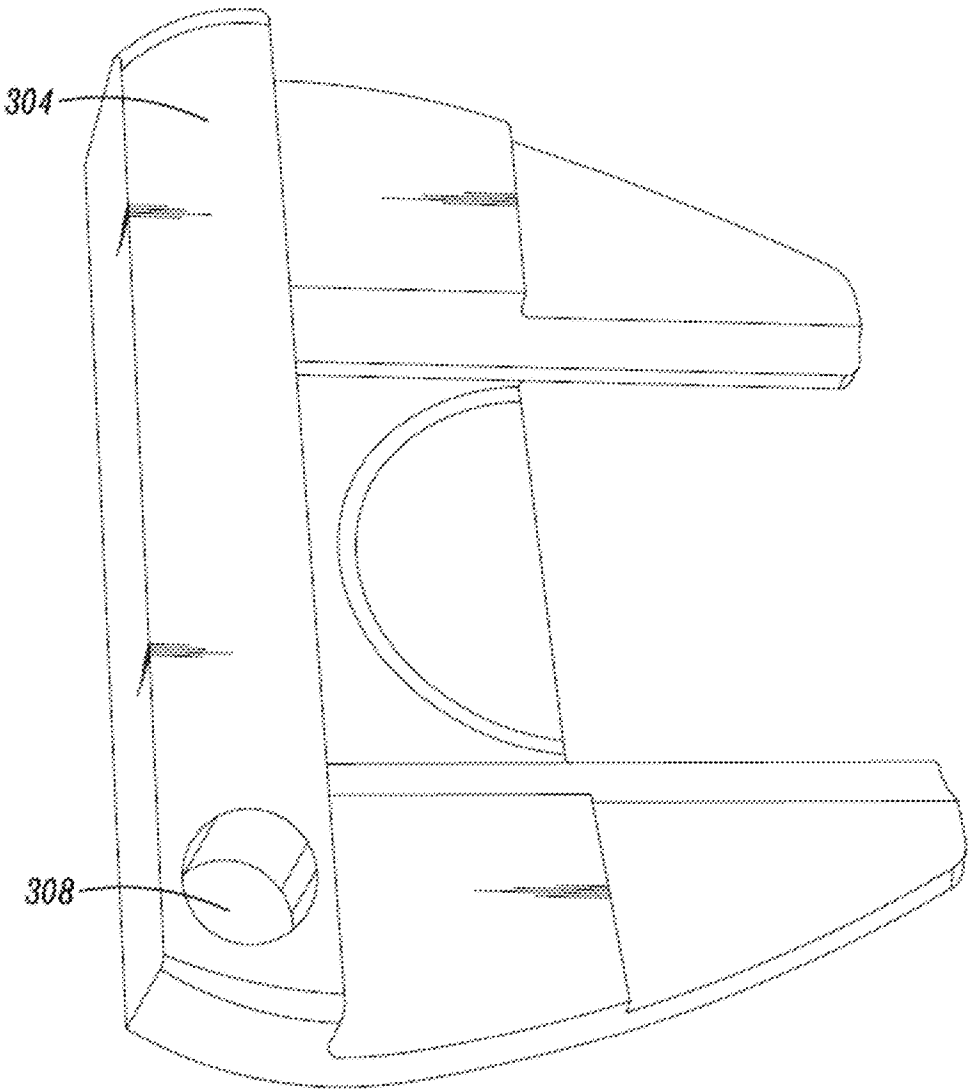
FIG. 3 is a perspective view of a right-handed putter head that does not include a cylindrical post and includes a cylindrical recessed portion.

FIGS. 2 and 3 include perspective views of example putter heads for golf clubs. FIG. 2 includes a left-handed putter head 204 including a cylindrical post 208. The cylindrical post 208 is part of the putter head 204 and is provided for attachment of a golf shaft via an inner diameter (hollow interior) of the golf shaft. In other words, an outer diameter of the cylindrical post 208 may be fixed to an inner diameter of the tip end of a golf shaft. The cylindrical post 208 may be referred to as a spud.

FIG. 3 includes a right-handed putter head 304 that does not include a cylindrical post. Instead, the putter head 304 includes a cylindrical recessed portion (cup or bore) 308 that is provided for attachment of a golf shaft via an outer diameter and surface of the golf shaft. In other words, an outer diameter of the cylindrical recessed portion 308 may be fixed to an outer diameter of the tip end of a golf shaft.

The cylindrical recessed portion 308 may be slightly larger than (e.g., 0.01" larger or another suitable value) approximately 0.350" to 0.500" for straight graphite shafts that do not have a tapered tip end and slightly larger than approximately 0.333" to 0.370" for some straight golf shafts that have a tapered tip end. The taper rate of tip ends of graphite golf shafts having tapered tip ends may be approximately 0.0075 inches diameter (e.g., outer) per inch axially to 0.02 inches diameter per inch axially or another suitable taper rate.

The present application is applicable for use with right-handed putter heads, left handed putter heads, putter heads with cylindrical posts (e.g., 208), and putter heads with cylindrical recessed portions (e.g., 308). Also, while example types of putter heads are illustrated, the present application is also applicable to other types of putter heads, such as blade putter heads, half mallet putter heads, (full) mallet putter heads, and other types of putter heads.

Bent graphite and carbon fiber golf club shafts are difficult and costly to manufacture and may be susceptible to damage. Steel golf shafts including one or more bends club shafts may be more easily manufactured and may be less costly than even straight graphite shafts and straight carbon fiber golf shafts.

The present application involves a carbon fiber tip that includes one or more bends. The carbon fiber tip allows a straight (e.g., graphite or carbon fiber or steel) golf shaft (and other types of straight golf shafts) to be attached to a putter head via the carbon fiber tip instead of using a putter shaft that itself with one or more bends. Golf shafts with one bend may be referred to as single bend golf shafts, while golf shafts with two bends may be referred to as double bend golf shafts.

The carbon fiber tip is configured to not change the loft angle or the lie angle of the putter head outside of predetermined ranges despite the use of a straight golf shaft. Example lie angles may be approximately 70 degrees+/−10 degrees with respect to a flat ground surface. Example loft angles may be approximately 2 to 7 degrees with respect to a flat ground surface.

Figure 4:
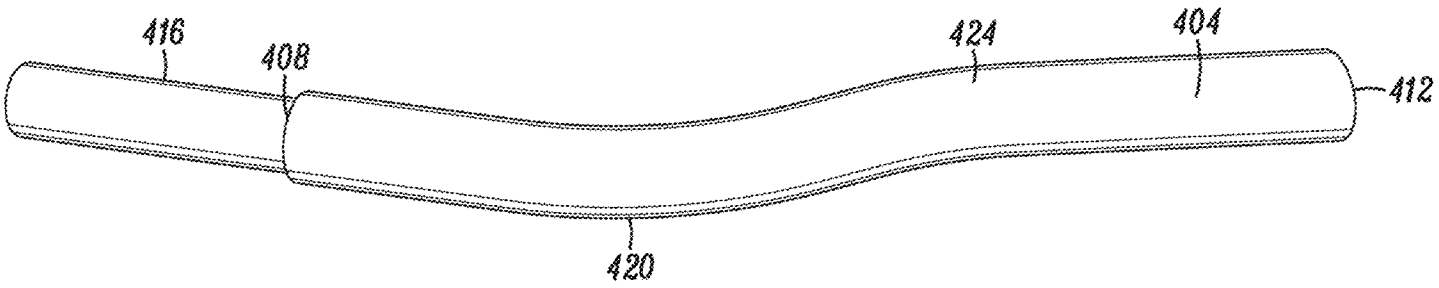
FIGS. 4-8 are perspective views of an example carbon fiber tip that includes two bends.

FIG. 4 is a side view of an example carbon fiber tip 404 that includes two bends. The carbon fiber tip 404 includes a shaft (first) end 408 and a head (second) end 412. The head end 412 is to be connected to a golf club head, such as putter heads with a cylindrical post (e.g., 208) or with a cylindrical recessed portion (e.g., 308). The shaft end 408 is to be connected to a straight golf shaft, such as a straight graphite golf shaft or a straight carbon fiber golf shaft or a straight steel golf shaft. The head end 412 may be joined with/fixed to the putter head, for example, by via an adhesive such as an epoxy or in another suitable manner. The carbon fiber tip 404 may be a hollow cylindrical tube with one or more bends.

A portion of a cylindrical tube 416 may be fixed within the interior of the carbon fiber tip 404 at the shaft end 408. The cylindrical tube 416 may be joined with/fixed to the interior of the carbon fiber tip 404, for example, by via an adhesive such as an epoxy or in another suitable manner. In various implementations, the carbon fiber tip 404 may be over molded onto the cylindrical tube 416. The cylindrical tube 416 may be, for example, steel, a metal, an alloy, a plastic, carbon fiber, or another suitable material. The carbon fiber tip 404 may be compression molded with a foam inside of the carbon fiber tip 404 or manufactured in another suitable manner.

The remainder of the cylindrical tube 416 may extend outwardly past the shaft end 408. The remainder of the cylindrical tube 416 extends into the hollow interior of the straight golf shaft 104 and is fixed within or joined to the straight golf shaft 104. The cylindrical tube 416 may be joined with/fixed to tip end 108 of the straight golf shaft 104, for example, by via an adhesive such as an epoxy or in another suitable manner.

In the example of FIG. 4, the carbon fiber tip 404 includes two bends 420 and 424. The axis along which the carbon fiber tip 404 extends changes at each of the bends 420 and 424.

Figure 5:
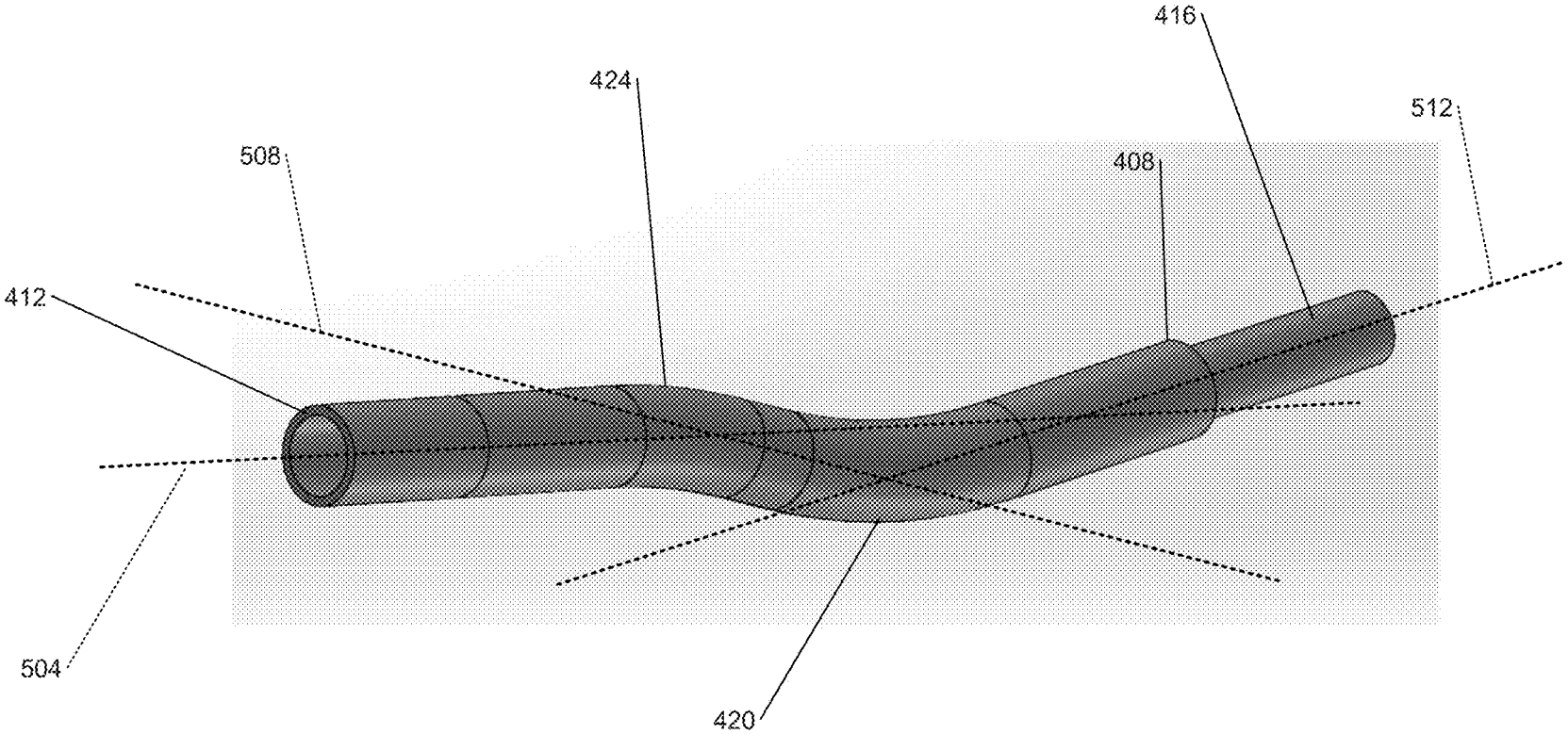

FIG. 5 includes another perspective view of the example of the carbon fiber tip 404. As illustrated in FIG. 5, from the carbon fiber tip 404 extends along a first axis 504 from the end 412 to the bend 424. Between the bend 424 and the bend 420, the carbon fiber tip 404 extends along a second axis 508. Between the bend 420 and the end 408, the carbon fiber tip 404 extends along a third axis 512. The first axis 504 is not coaxial with the second axis 508 and is not coaxial with the third axis 512. The second axis 508 is not coaxial with the third axis 512. In various implementations, the first axis 504 may intersect the second axis 508 at only one point. In various implementations, the second axis 508 may intersect the third axis 512 at only one point. In various implementations, the first axis 504 may or may not intersect the third axis 512 if the first and third axes 504 and 512 are extended into space.

Figure 6:
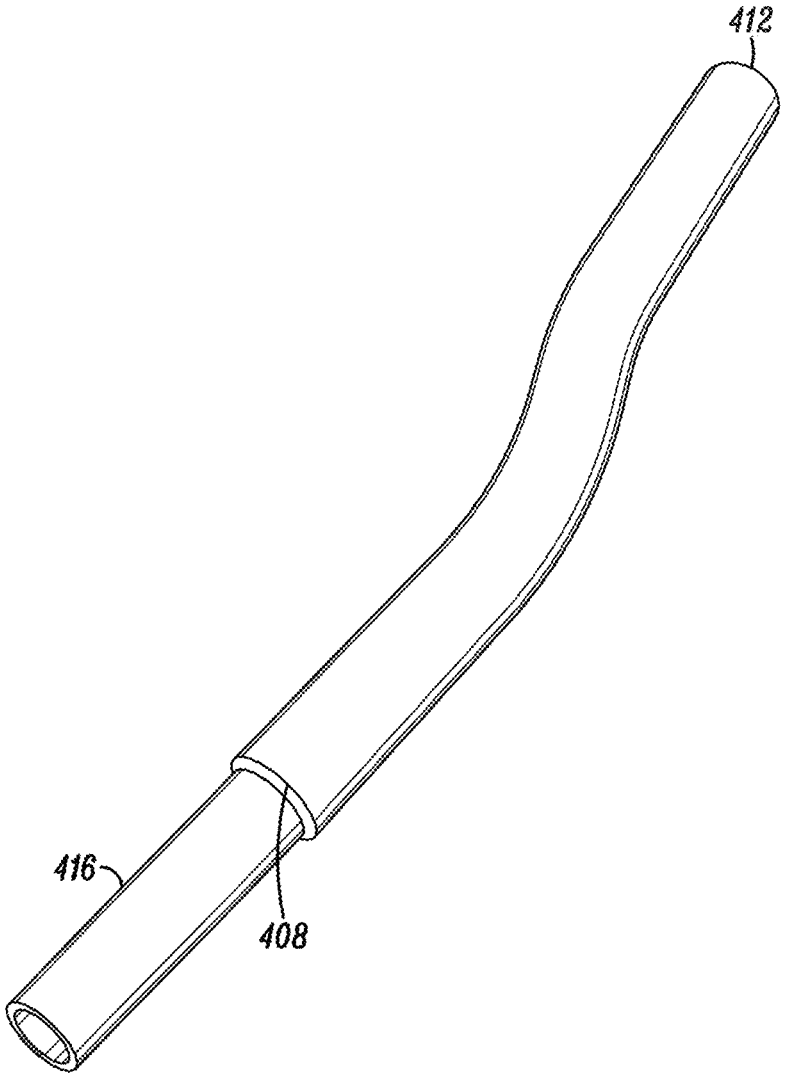
Figure 7:
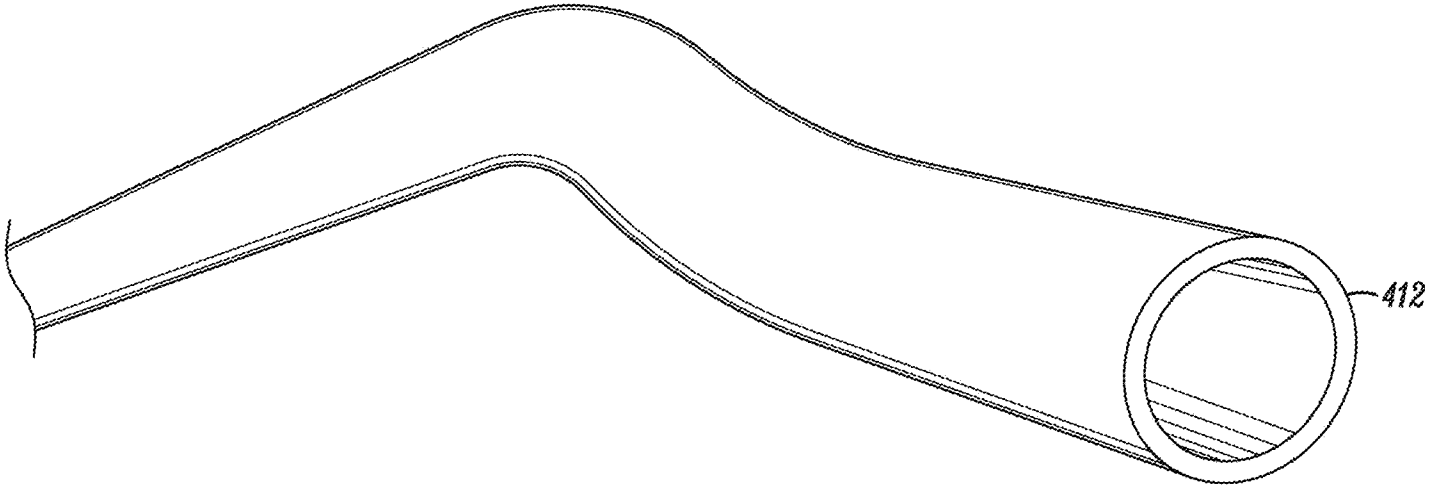
Figure 8:
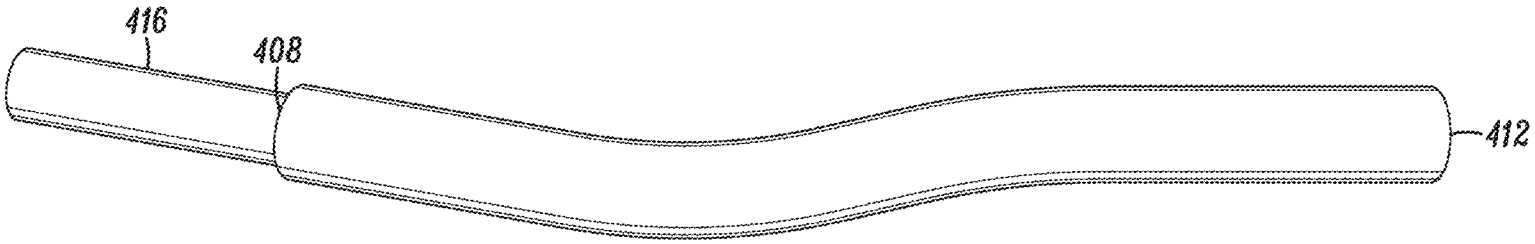
Figure 9:
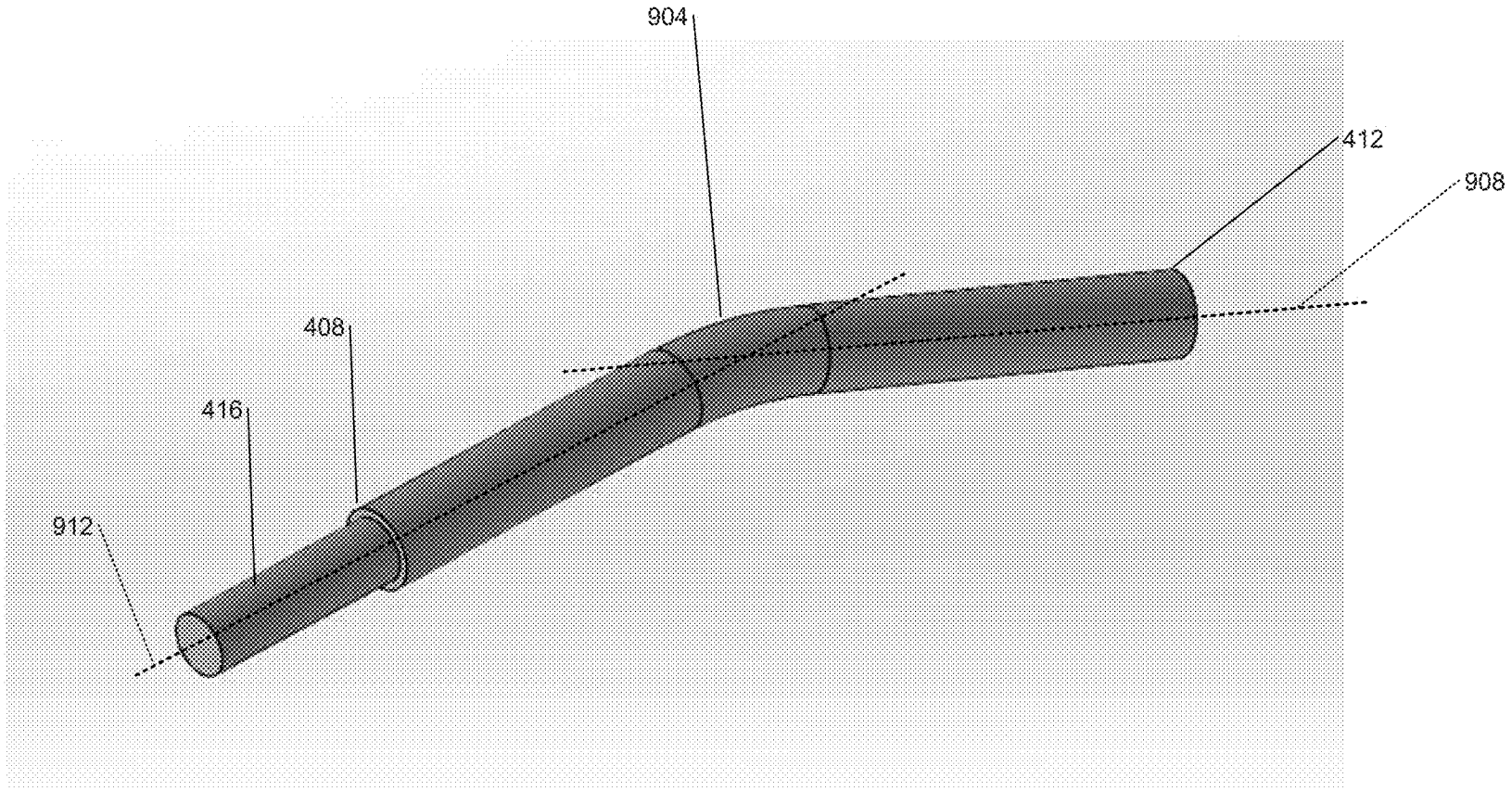
FIGS. 9-12 include perspective views of an example of the carbon fiber tip including only a single bend.

FIGS. 6, 7, and 8 includes other perspective views of the example of the carbon fiber tip 404. FIG. 7 is from the perspective facing the head end 412.

FIGS. 9-12 include perspective views of an example of the carbon fiber tip 404 including only a single bend 904. In this example, the carbon fiber tip 404 extends along a first axis 908 between the head end 412 and the bend 904. The carbon fiber tip 404 extends along a second axis 912 between the bend 904 and the shaft end 408. In various implementations, the first and second axes 908 and 912 are not coaxial and may intersect at only one point.

Figure 10:
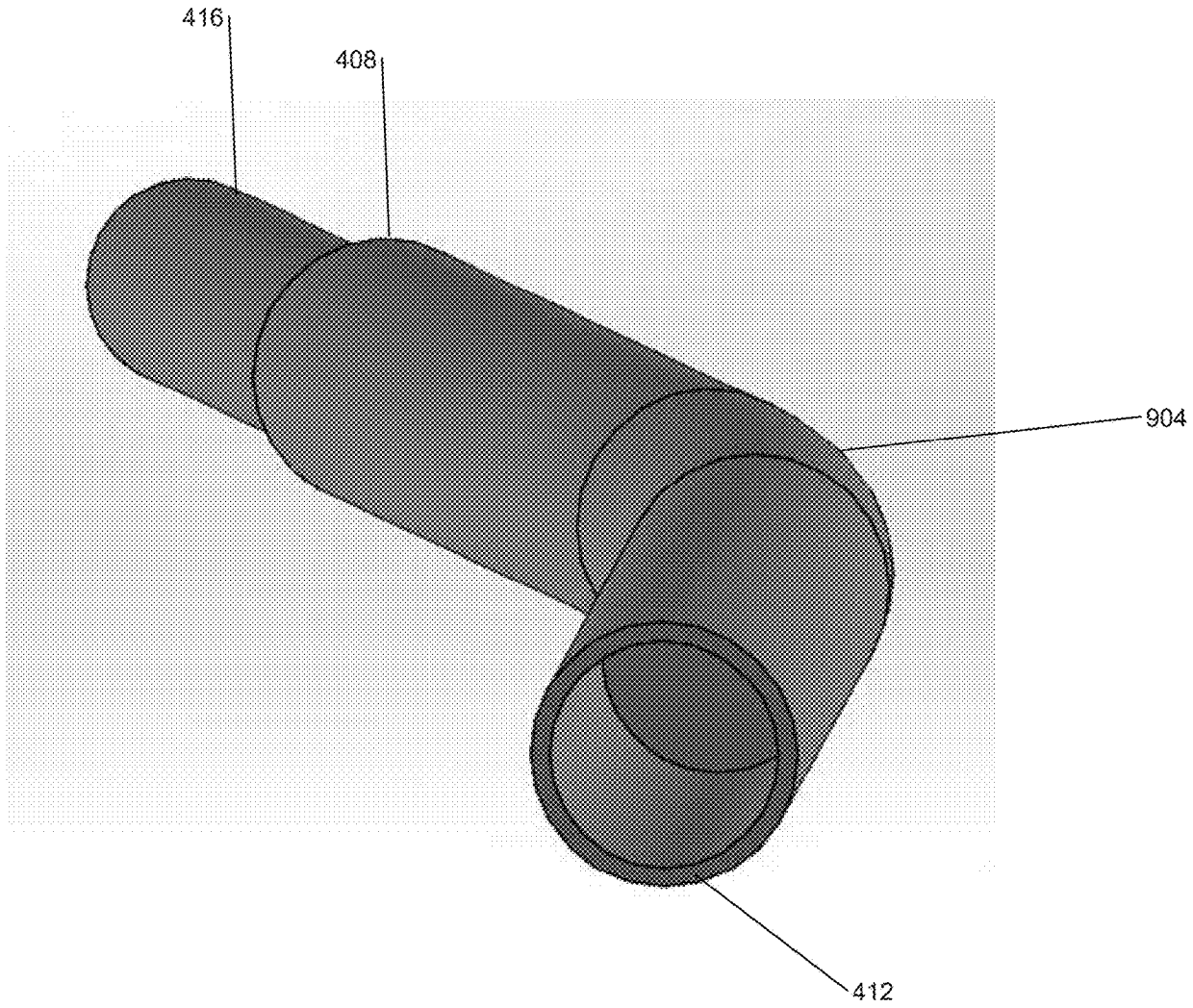
Figure 11:
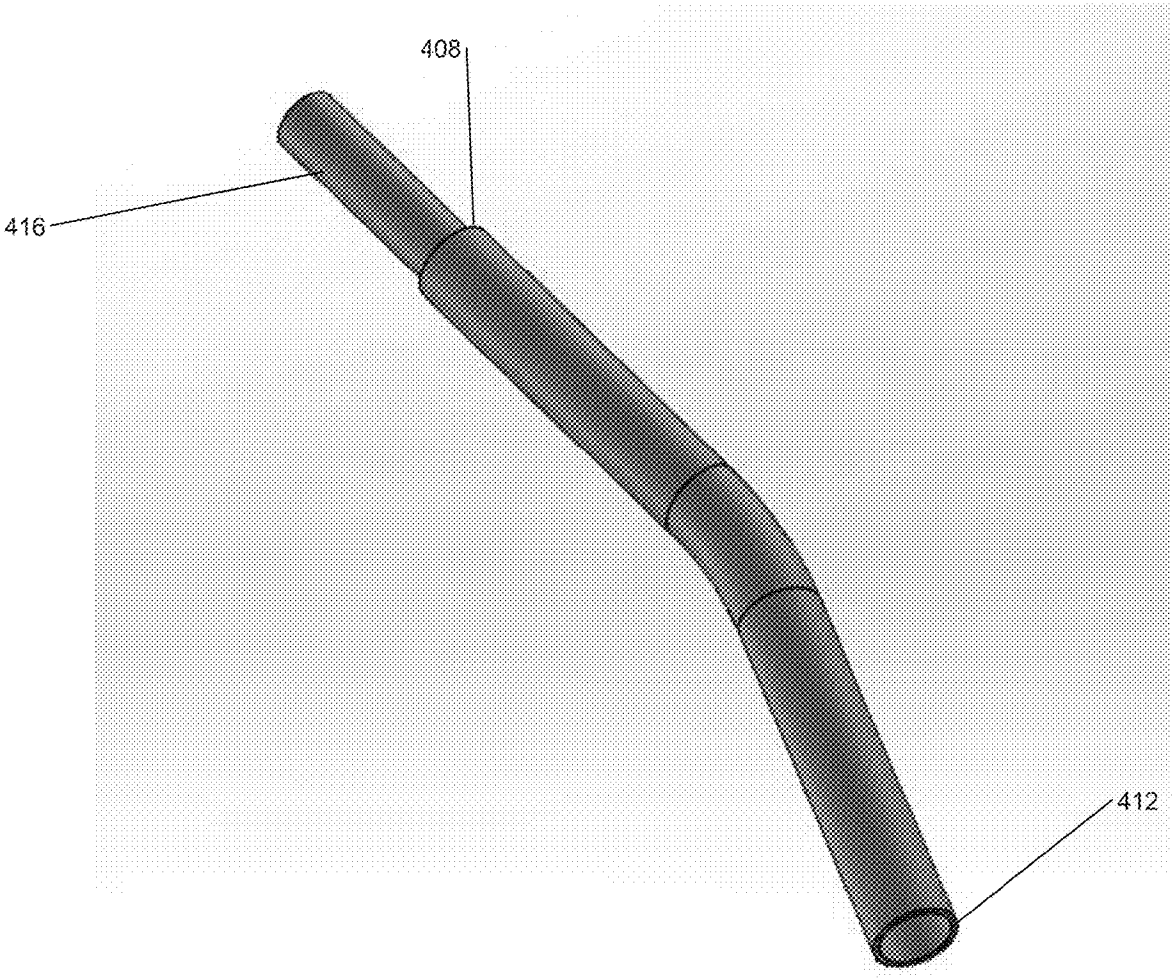
Figure 12:
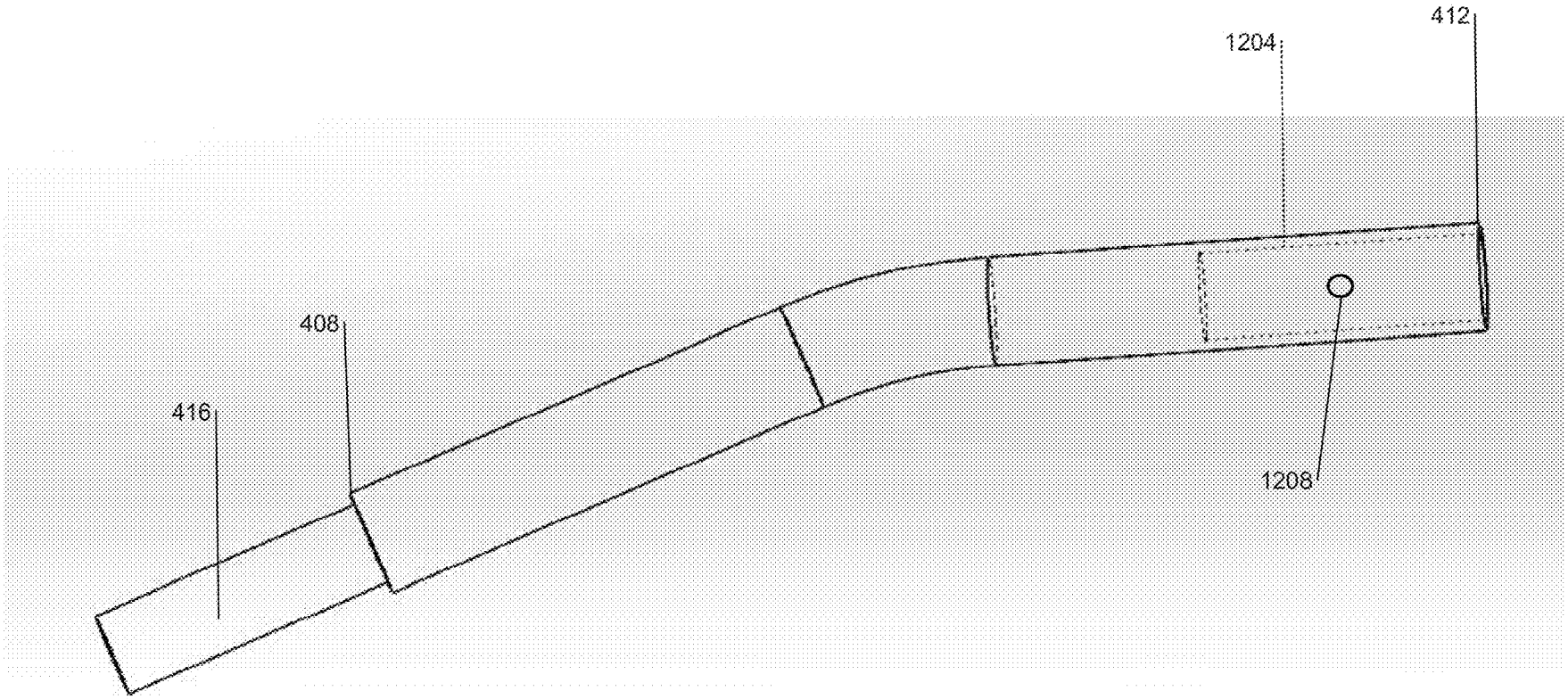

FIG. 10 is from the perspective facing the head end 412. FIG. 12 illustrates a spud (e.g., 208) extending into the interior of the head end 412 at 1204. In other words, the end 412 may include a cylindrical inner portion 1204 that is configured to receive a cylindrical post, such as the post 208 of FIG. 2.

In various implementations, one or more vent apertures 1208 may extend through the adapter 404 (from an outer diameter) to the cylindrical inner portion 1204. The aperture (s) 1208 may prevent the cylindrical post of the putter head from being pushed out of the cylindrical inner portion 1204, such as by an adhesive during curing. The aperture(s) 1208 may be, for example, perpendicular to the cylindrical walls of the cylindrical inner portion 1204.

Figure 13:
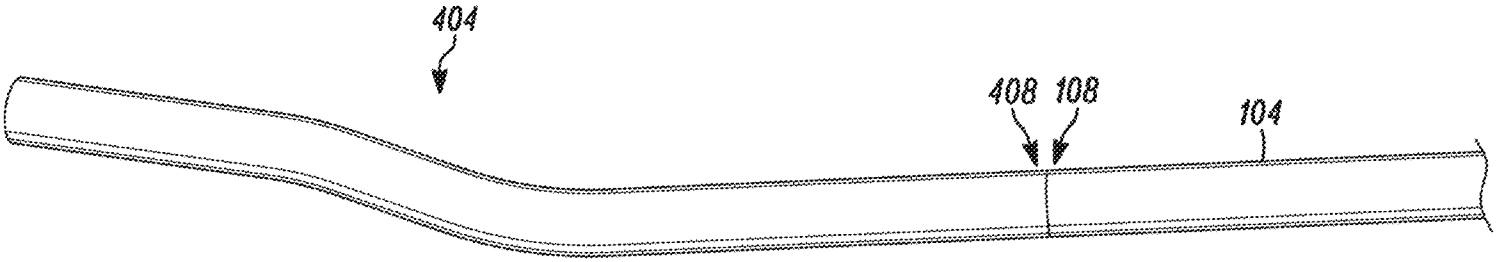
FIGS. 13 and 14 include example perspective views of the carbon fiber tip including two bends joined with a straight golf shaft.
Figure 14:
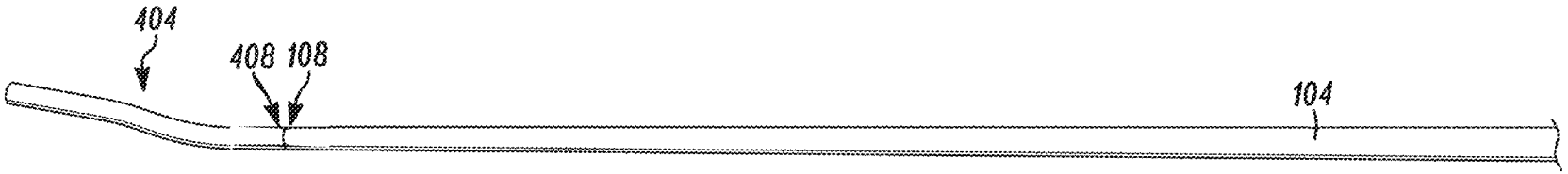

FIGS. 13 and 14 include example perspective views of the carbon fiber tip 404 including two bends joined with a straight golf shaft 104.

The carbon fiber tip 404 may be joined with/fixed to the tip end 108 of the straight golf shaft via an adhesive such as an epoxy, co-bonded (e.g., cured with the straight shaft while connected to the golf shaft), or in another suitable manner. The carbon fiber tip 404 may be joined with the straight golf shaft with the shaft end 408 facing the tip end 108 and with the shaft end 408 close to or directly contacting the tip end 108.

In the example of the tip end 108 not directly contacting the shaft end 408 of the carbon fiber tip 404, a gap between the tip end 108 and the shaft end 408 may be filled, such as with an epoxy, and smoothed.

Figure 15:
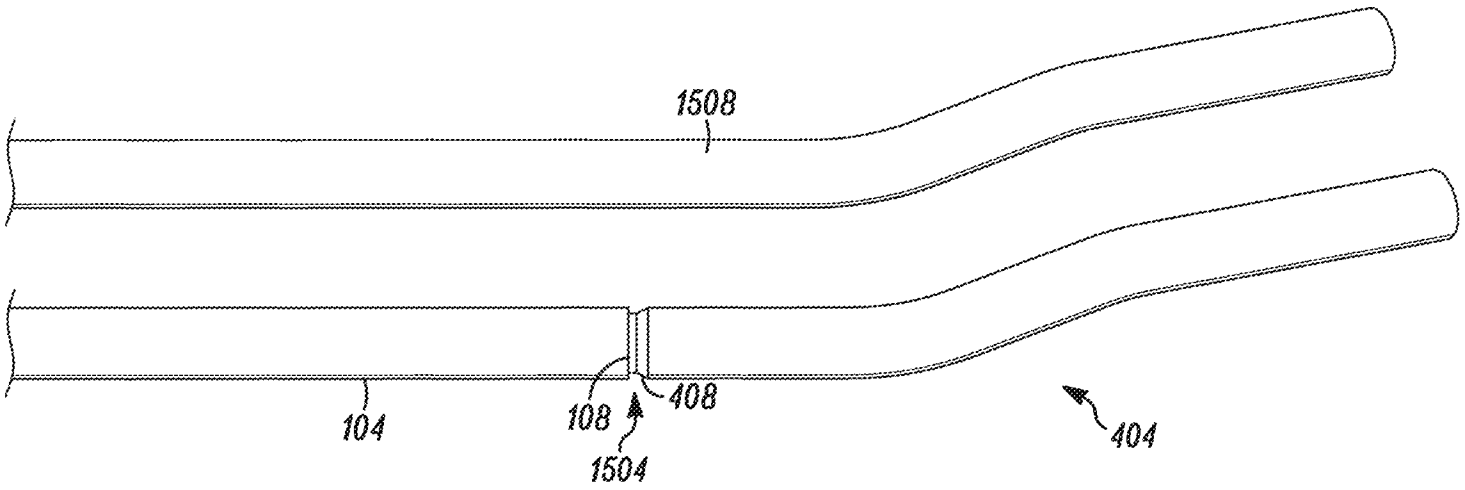
FIG. 15 includes a perspective view of an example of the carbon fiber tip joined with the straight golf shaft.

For example, FIG. 15 includes a perspective view of an example of the carbon fiber tip 404 joined with the straight golf shaft 104. A gap 1504 is disposed between the tip end 108 of the straight golf shaft 104 and the shaft end 408 of the carbon fiber tip 404. The gap 1504 may be filled with one or more materials, such as with an epoxy, to provide a constant outer diameter or taper rate from the tip end 108 to the shaft end 408, such as illustrated in FIGS. 13 and 14. The epoxy or other material may be smoothed while the epoxy is still wet (not yet cured), such as using a squeegee or a sponge. The epoxy or other material may be sanded after being cured to provide a smooth outer surface where the gap 1504 was. The material added to the gap 1504 may be the same color as the material of the carbon fiber tip 404 and the straight golf shaft 104. In various implementations, the material added to fill the gap 1504 may be included in the carbon fiber tip 404 and/or the straight golf shaft 104. FIG. 15 also illustrates an example single piece steel shaft 1508 having similar bends to that accomplished using the carbon fiber tip 404.

The end 408 may be cylindrical, and the end 412 may be cylindrical. The end 412 may be configured to fit within a cylindrical recessed portion of the putter head, such as 308 of FIG. 3. In this example, an outer diameter of the first end 408 is fixed to an inner diameter of the cylindrical recessed portion of the putter head.

The use of the carbon fiber tip 404 allows for the head end 412 to have a smaller outer diameter than the head ends of other carbon fiber shafts because a wall thickness of the head end 412 is less than the wall thicknesses of the head ends of other carbon fiber shafts. The diameter of the head end 412 of the carbon fiber tip 404 may be, for example, approximately 0.370 inches or less.

The head end 412 of the carbon fiber tip 404 may be joined with/fixed to the putter head, for example, by via an adhesive such as an epoxy or in another suitable manner. The end 408 may be joined with/fixed to the tip end of the straight golf shaft via an adhesive such as an epoxy, co-bonded (e.g., cured with the straight graphite shaft while connected to the straight graphite golf shaft), or in another suitable manner.

Figure 16:
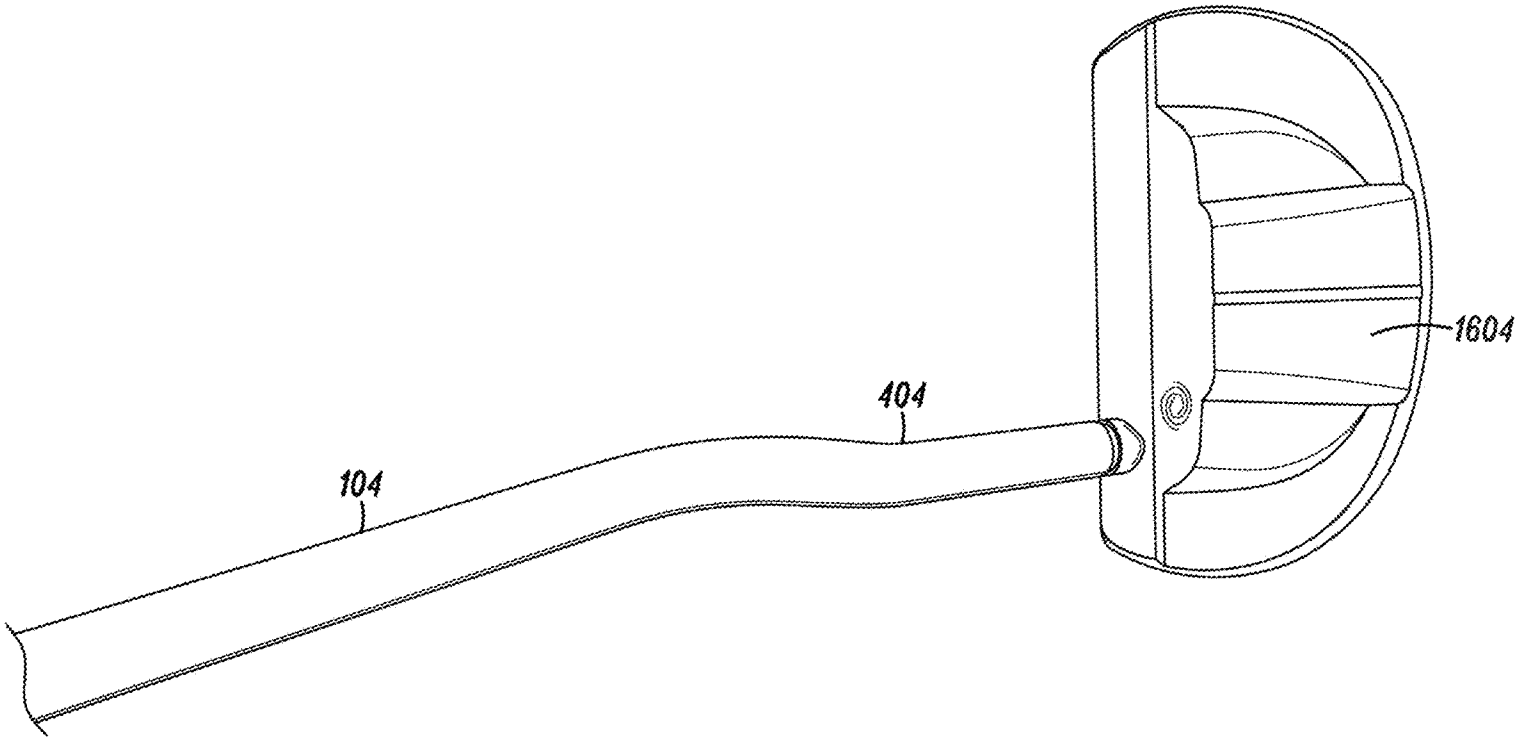
FIG. 16 includes an example perspective view of the carbon fiber tip joined with/fixed to the shaft end with the straight golf shaft and joined with/fixed to a golf club head.

FIG. 16 includes an example perspective view of the carbon fiber tip 404 joined with/fixed to the shaft end 408 with the straight golf shaft 104 and joined with/fixed to a golf club head 1604, such as a putter head.

While the example of the carbon fiber tip and the straight carbon fiber golf shaft is described above, the present application and the above is also applicable to a single piece carbon fiber golf shaft that is made of carbon fiber and an epoxy (no other material) and that includes one or more bends. The single piece would include both a straight section (e.g., like the straight carbon fiber golf shaft above) and one or more bends (e.g., like the carbon fiber tip above).

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

The invention claimed is:

1. A carbon fiber tip to connect a straight carbon fiber golf shaft with a golf club head, the carbon fiber tip comprising:

a first end that is cylindrical and that is configured to be joined with the golf club head;

a second end that opposite the first end, that is cylindrical, and that is configured to be joined with a tip end of the straight carbon fiber golf shaft;

a bend disposed between the first end and the second end that changes an axis along which the carbon fiber tip extends; and a foam that is compression molded within the carbon fiber tip.

2. A golf club, comprising:

the straight carbon fiber golf shaft having a tip end and a grip end that is opposite the tip end;

the golf club head; and the carbon fiber tip of claim 1, wherein the first end of the carbon fiber tip is joined with the golf club head and the second end of the carbon fiber tip is joined with the tip end of the straight carbon fiber golf shaft.

3. The golf club of claim 2 wherein the golf club head is a putter head.

4. The golf club of claim 2 wherein the first end of the carbon fiber tip is fixed to the golf club head via an adhesive.

5. The golf club of claim 2 wherein the second end of the carbon fiber tip is fixed to the tip end of the straight carbon fiber golf shaft via an adhesive.

6. The golf club of claim 2 wherein the second end of the carbon fiber tip is fixed to the tip end of the straight carbon fiber golf shaft via the carbon fiber tip and the straight carbon fiber golf shaft having been cured together.

7. The carbon fiber tip of claim 1 wherein the first end includes a cylindrical recessed portion configured to receive a cylindrical post on the golf club head.

8. The carbon fiber tip of claim 1 wherein an outer diameter of the first end is between 0.3 inches to 0.4 inches.

9. A tip comprising:

the carbon fiber tip of claim 1; and a cylindrical tube disposed within the second end that extends outwardly past the second end of the carbon fiber tip.

10. The tip of claim 9 wherein the carbon fiber tip is co-molded onto the cylindrical tube.

11. The tip of claim 9 wherein the cylindrical tube is to extend into a tip end of the straight carbon fiber golf shaft.

12. The tip of claim 9 wherein the cylindrical tube is made of one of steel, a metal, an alloy, and carbon fiber.

13. The carbon fiber tip of claim 1 wherein the straight carbon fiber golf shaft is straight axially and does not include any bends along the axis of the straight carbon fiber golf shaft.

14. The carbon fiber tip of claim 1 further comprising a second bend disposed between (a) the bend and (b) the first end.

15. The carbon fiber tip of claim 14 wherein the carbon fiber tip:

extends axially along a first axis between the bend and the second end;

extends axially along a second axis between the bend and the second bend; and extends axially along a third axis between the second bend and the first end, wherein the first axis is not coaxial with the second axis, and the second axis is not coaxial with the third axis.

16. The carbon fiber tip of claim 15 wherein the first axis is not coaxial with the third axis.

17. The carbon fiber tip of claim 15 wherein the first axis intersects the second axis at only one point, and the second axis intersects the third axis at only one point.

18. A golf shaft for a putter, the golf shaft comprising:

a straight carbon fiber golf shaft having a tip end and a grip end that is opposite the tip end; and the carbon fiber tip of claim 1, the first end of the carbon fiber tip to be joined with the golf club head and the second end of the carbon fiber tip to be joined with the tip end of the straight carbon fiber golf shaft.

19. A carbon fiber tip to connect a straight carbon fiber golf shaft with a golf club head, the carbon fiber tip comprising:

a first end that is cylindrical and that is configured to be joined with the golf club head;

a second end that opposite the first end, that is cylindrical, and that is configured to be joined with a tip end of the straight carbon fiber golf shaft; and a bend disposed between the first end and the second end that changes an axis along which the carbon fiber tip extends, wherein the first end includes a cylindrical recessed portion, and wherein the first end includes one or more apertures that extend through a side wall of the carbon fiber tip and to the cylindrical recessed portion.

* * * * *